US005228629A

United States Patent [19]

Bernhard et al.

[11] Patent Number: 5,228,629

[45] Date of Patent: Jul. 20, 1993

[54] GRINDING ELEMENT FOR DRUM REFINER

[76] Inventors: Emmerich Bernhard, Grazerstrasse 44a, 8045 Graz; Johann Liłeg, Grazerstrasse 44a, 8045 Graz; Johannes Kappel, Musilgasse 8, 8041 Graz; Dag Berglöff, Goethestrasse 44, 8010 Graz; Bernhard Rebernik, Rosenhaingasse 8, 8010 Graz, all of Austria; Sven-Erik Henriksson, 518 Alpine Court, North Vancover, B.C. V7R 2L5, Canada

[21] Appl. No.: 866,077

[22] Filed: Apr. 1, 1992

Related U.S. Application Data

[63] Continuation of Ser. No. 549,780, Jul. 9, 1990, abandoned, which is a continuation of Ser. No. 267,473, Nov. 4, 1988, abandoned.

[30] Foreign Application Priority Data

Nov. 5, 1987 [AT] Austria ..... 2924/87

[51] Int. Cl.[5] ..... B02C 19/00

[52] U.S. Cl. ..... 241/261.1; 241/295

[58] Field of Search ..... 241/261.2, 261.3, 296, 241/297, 298, 261.1, 295, 244

[56] References Cited

U.S. PATENT DOCUMENTS 4,355,768 10/1982 Johansson ..... 241/298 X 5,048,768 9/1991 Bernhard et al. ..... 241/261.1

*Primary Examiner*—Mark Rosenbaum

*Assistant Examiner*—Frances Chin

*Attorney, Agent, or Firm*—Seidel, Gonda, Lavorgna & Monaco

[57] ABSTRACT

The invention relates to a crushing or grinding element for drum refiners having an engine-driven rotor for the crushing or grinding of fibrous materials. The element is attachable to the rotor shell and has crushing or grinding surfaces of increasing diameter and optionally crushing or grinding surfaces of steeper inclination to the rotor axis immediately adjacent the crushing or grinding surfaces inclined to the rotor axis provided on the rotor shell. The grinding surfaces are symmetrical to the median plane of the material feed. The invention is characterized in that the crushing or grinding element(s) is (are) formed as (a) segment(s) placed around the circumference of the rotor having anchoring projections of hammerhead-like cross section on the side facing the rotor axis and which are engageable in corresponding rotor grooves of hammerhead-like cross section.

11 Claims, 6 Drawing Sheets

GRINDING ELEMENT FOR DRUM REFINER

This application is a continuation of Ser. No. 07/549,780 filed Jul. 9, 1990 which, in turn, is a continuation of Ser. No. 07/267,473 filed Nov. 4, 1988, now abandoned.

FIELD OF THE INVENTION

The invention relates to crushing or grinding elements used in drum refiners comprising an engine-driven rotor for the crushing or grinding of fibrous material.

BACKGROUND OF THE INVENTION

A drum refiner has an element which is attachable to the rotor shell and comprises crushing or grinding surfaces having increasing diameters. Crushing or grinding surfaces of steeper inclination in relation to the rotor axis which are immediately adjacent to other crushing or grinding surfaces of this type are subject to wear. This is especially true when the crushing or grinding surfaces are conical shaped. Such surfaces must be repeatedly replaced during the use of the drum refiners to assure appropriate crushing or grinding performance.

Most prior art refiners are used for the mechanical production of wood pulp. They comprise a disk equipped with grinding plates rotating about a horizontal axis. An opposing disk corresponding with this disk is also provided with grinding plates which can be either rotating or stationary. In these known embodiments, at least an essential portion of the grinding gap extends vertically or inclined towards the axis of rotation in the area of the marginal zone. Since high contact pressure of the grinding plates is required for the grinding operation, the aforementioned known embodiment causes excessive stress on the material and above all on the bearings which limits the maximum admissible refiner throughput. The resulting use of high mechanical energy causes the generation of considerable amounts of steam in the grinding gap because mainly wet or humid material is ground. For a good utilization or recovery of energy and a largely unhampered charging of the chips or the like, an adequate discharge of the steam together with the fibrous material thus produced or recovered is aimed at, but difficult to put into practice because of the large amount of steam generated. Particularly aggravating is the vertical arrangement of the grinding gap in conventional disk refiners, as these bring about a partial separation of the fibrous material and a strong backflow of the generated steam.

A refiner is known per se in which a conical trunnion is provided on its periphery with crushing bars of varying lengths and arranged in the conical interior space of a housing whose interior wall is provided with corresponding opposing bars so that a grinding gap of 1 to 2 mm dimension results. The material feed is effected on one side of the machine within the area of the trunnion shaft. The output of this refiner is unsatisfactory because the material feed is effected from only one side and immediately on the shaft directed into the conical grinding gap. There is no satisfactory defibration and no adequate pulping effect. This also applies in a similar manner to the known conical refiners.

Also belonging to the state of the art is a microatomizer in which grinding stock is fed centrally from the top via a screw conveyor to hollanders extending parallel to the axis of a separator impeller wheel, the hollanders forming a gap extending parallel to said axis with the housing receiving said impeller wheel which is provided with small notches on its inner wall. The grinding stock ground in the parallel gap is conveyed toward the center of the grinding zone by an air stream and in doing so passes said separator impeller wheel. The coarse grinding matter separated therein is returned to the grinding zone. Two blower wheels arranged on both sides of the grinder shaft generate the required air stream. Aside from the fact that in this known embodiment, there are no conical grinding gaps or the like adjacent the grinding gaps parallel to the axis, it is not suitable for processing chips or other wet fibrous material, not to mention its elaborate construction.

SUMMARY OF THE INVENTION

The present invention is directed to a drum refiner having crushing or grinding element(s) formed as segment(s) situated around the circumference of the rotor shell. The crushing or grinding surfaces are of increasing diameter and steeper inclination to the rotor axis immediately adjacent the crushing or grinding surfaces inclined to the rotor shell. The grinding elements are symmetrical to the median plane of the material feed. Each segment has anchoring projections of hammerhead-like cross section on the side facing the rotor axis and engageable in corresponding grooves of hammerhead-like cross section located on the rotor surface. Segments of this type have two main advantages: first, the segments easily slide in and out of the corresponding rotor grooves, e.g. releasable wedges being used for firm anchoring. Secondly, it is possible to exchange individual areas or segments of the crushing or grinding surfaces on the rotor shell and leave the grinding surface portions which are lesser worn with the remaining segments attached to the rotor for further use.

The patterns of the crushing or grinding surfaces can be formed in any given manner, such as ribs, serrations, grooves and ribs or the like.

According to a further embodiment of the invention, ribs of hammerhead-like cross section for contacting two adjacent segments may be provided on the rotor shell for retaining the segment(s). A particularly secure seat of the segments during operation can be achieved if the transition surfaces between the hammerheads and the hammerhead stems are planes of which each forms an identical opposing acute angle open to the rotor axis, with respect to the plane of symmetry of the hammerheads. This effect may be increased if the lateral flanks of the segments in the anchored state are disposed in planes radially extending towards the rotor axis in the area outside of the hammerheads, with the lateral flanks of adjacent segments contacting one another.

BRIEF DESCRIPTION OF THE DRAWINGS

The invention is explained in the following by means of exemplary embodiments of a drum refiner to the production of wood pulp from chips, under reference to the accompanying drawings, wherein.

DETAILED DESCRIPTION OF THE PREFERRED EMBODIMENTS

Figure 1:
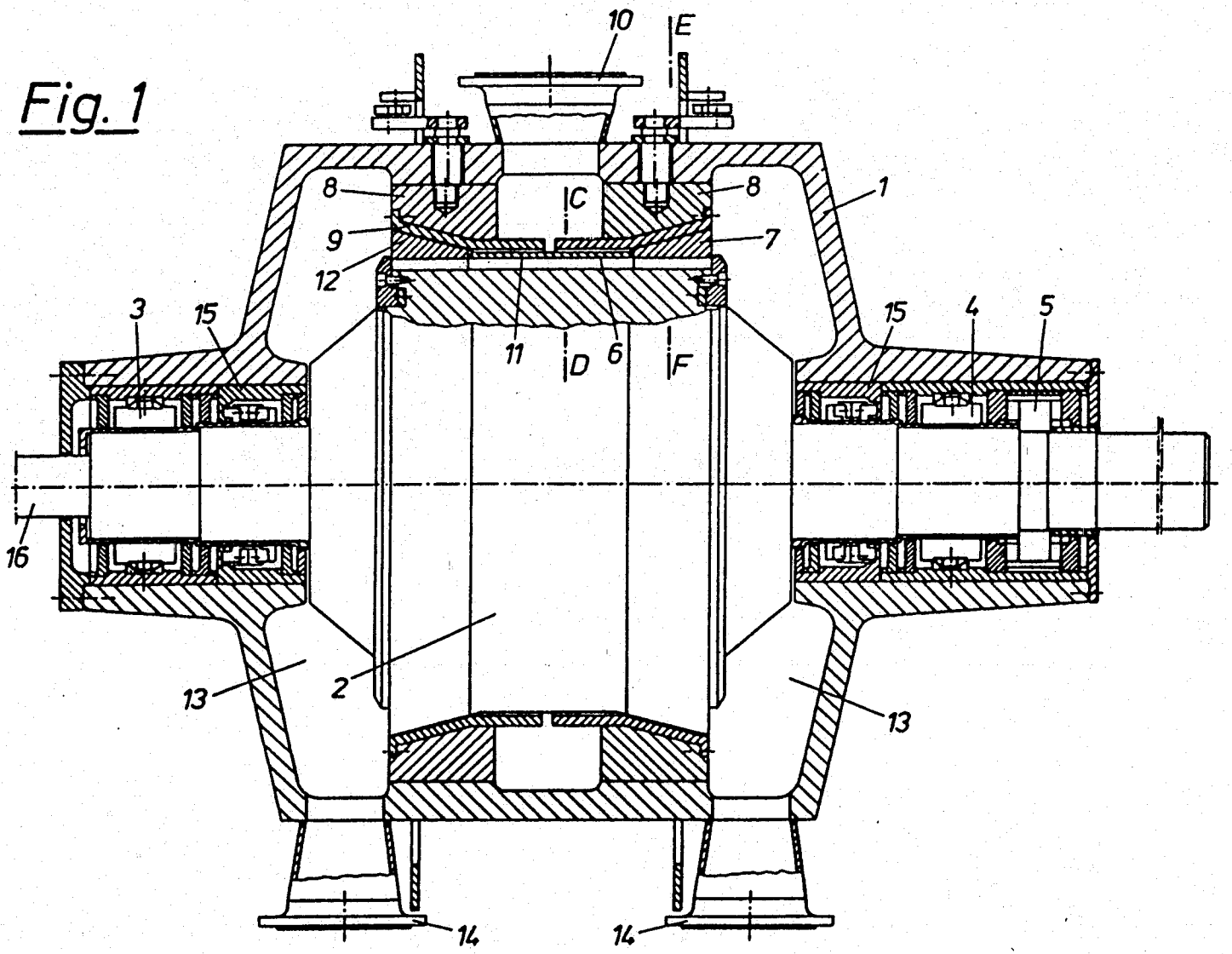
FIG. 1 shows an axial sectional view in the plane A–B according to FIG. 2.

FIGS. 1 to 5 show a preferably horizontally divided refiner housing 1 in which a cylindrical rotor 2 is supported on both sides by bearings 3, 4 and 5, which can be rolling or sliding bearings, but preferably sliding bearings with tilting segments, the type of bearing being used depending on diameter, capacity and number of revolutions per minute of the rotor. The rotor 2 is provided with grinding plates 6 and 7, grinding plate 6 being disposed along a cylindrical jacket part of the housing for precrushing the chips and grinding plate 7 enclosing an angle with the axis of the rotor serving for defibration. Due to the form of the grinding plate 7, an inclination of the grinding zone to the horizontal axis between 5° and 45°, preferably 15°, is achieved.

Opposing grinding plates 9 and 9' cooperating with the grinding plate 7 are provided on two stator rings 8 horizontally displaceable for the adjustment of the grinding gap.

Figure 3:
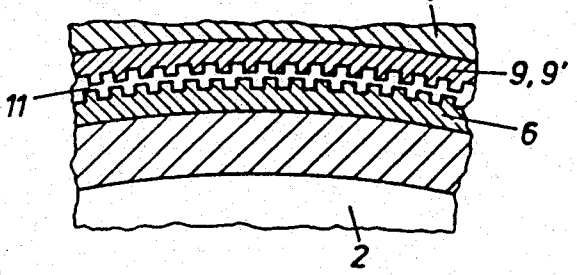
FIG. 3 shows a sectional view in the plane C–D of FIG. 1 at enlarged scale.
Figure 4:
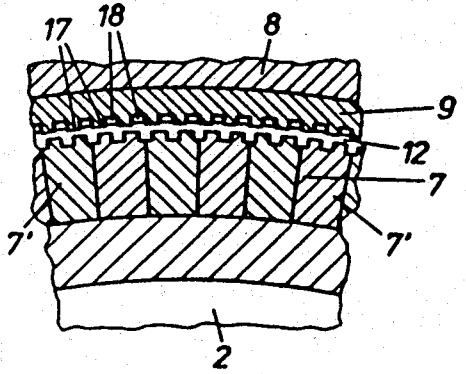
FIG. 4 shows a corresponding sectional view in the plane E–F again as an enlarged detail.
Figure 2:
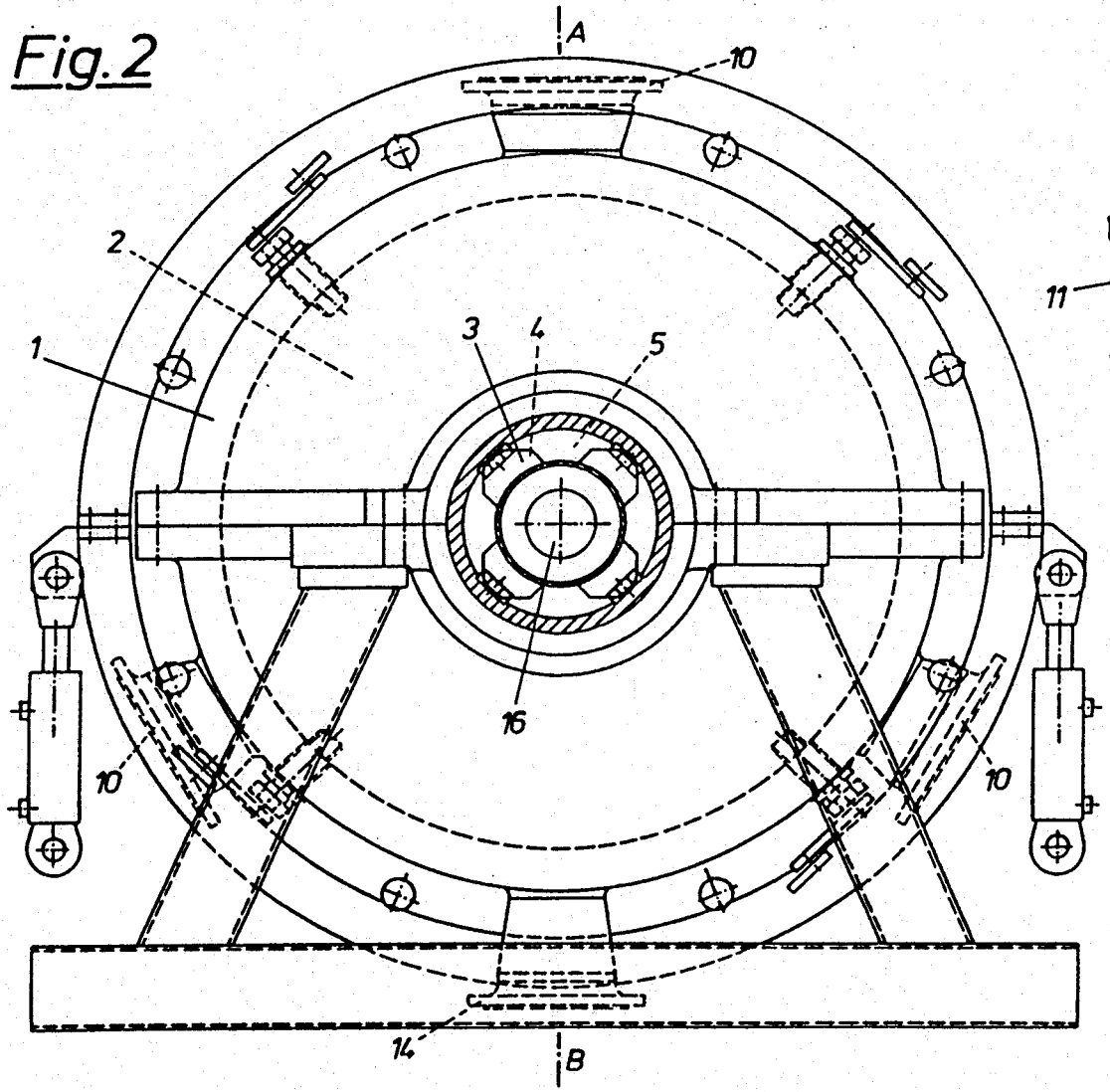
FIG. 2 shows a front view.
Figure 5:
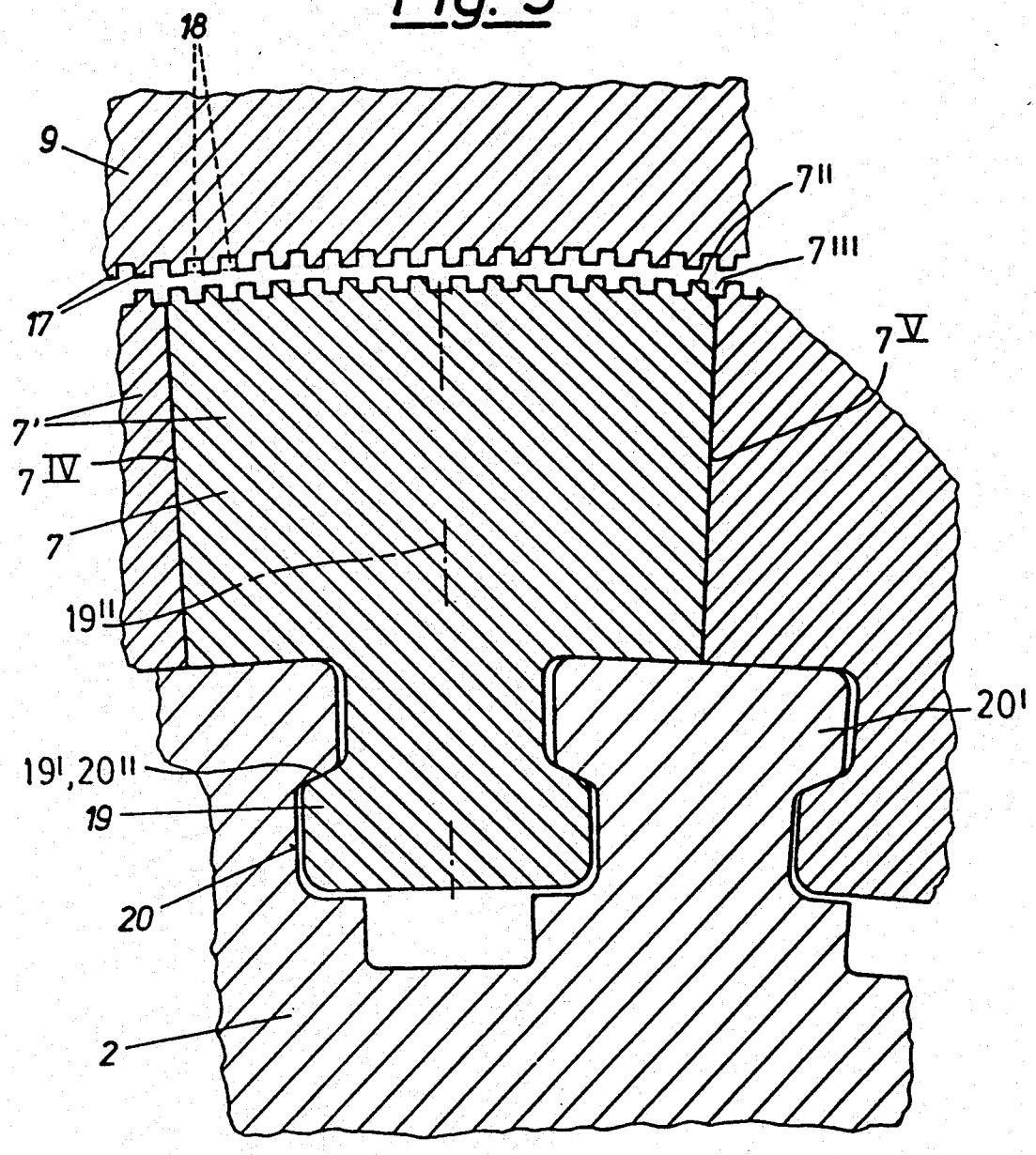
FIG. 5 shows a detail on even larger scale of a variant in a sectional view similar to FIG. 4.

FIGS. 3 and 4 show in slightly enlarged scale detail cross sections through the grinding plate area, FIG. 3 in the area parallel to the axis and FIG. 4 in the frustoconical area. According to FIG. 4, the opposing ribs 17 of the outer grinding plate 9 can be reinforced by means of cross webs or cross ribs 18. These webs or ribs 18 are provided in order to retain the fibrous material, thus to increase its dwell time in the grinding zone. The inner grinding plate 7 of the frustoconical area can be composed of segments 7' having grinding surfaces on the surface facing away from the rotor's central axis (FIG. 4). Such an embodiment of dimensions particularly well adapted to practice is shown in FIG. 5, although with only partly indicated cross webs 18. Anchoring lugs 19 in corresponding rotor grooves 20 of hammerhead-like cross section are provided.

The grinding surface of the segments 7' are provided with ribs 7'' and grooves 7'''. Between the rotor grooves 20 are ribs 20' of hammerhead-like cross section which each retain adjacent segments 7'. The transition surfaces 19', 20'' between the hammerheads and the hammerhead stems are planes, each of which forms an identical acute angle open towards the rotor axis of opposing direction with the plane of symmetry 19'' of the hammerheads. To reinforce the mechanical strength of the segments 7', the lateral flanks $7^{IV}$, $7^{V}$ of the segments 7' are disposed in planes radially extending to the rotor axis in the area outside of the hammerheads 18, with the lateral flanks of adjacent segments contacting one another.

The chips are fed by means of a conveyor screw, preferably radially from one to four material feeds 10 having openings on the periphery. The chips are precrushed in a horizontal grinding gap 11 and distributed symmetrically in both directions. The defibration of the wood is effected in the inclined adjustable grinding gap 12 with respect to the horizontal grinding gap 11. The grinding stock is then conveyed to the inner space 13 of the refiner housing 1 and is discharged at 14 together with the generated steam.

The bearings are sealed against the steam in the refiner housing via sealing units 15. On the free shaft end 16, an engine, preferably a direct current engine, of essentially lower output than the main engine, can be installed in order to reduce the starting current peak. The refiner of the present invention can be operated at much higher speeds than that of the prior art. The refiner of the present invention can be operated at up to 3,600 rpm.

The invention is advantageously applicable to refiners with vertically extending rotor shafts. The comminution of fibrous materials other than wood is easily effected by water or other liquids being added to the precrushed material under certain conditions.

According to the present invention, a considerable reduction of material stress is achieved in comparison to the known refiners. The stress on the bearings is decreased and the service life of the bearings is prolonged. As a result, an increase of material throughput can be obtained.

Figure 6:
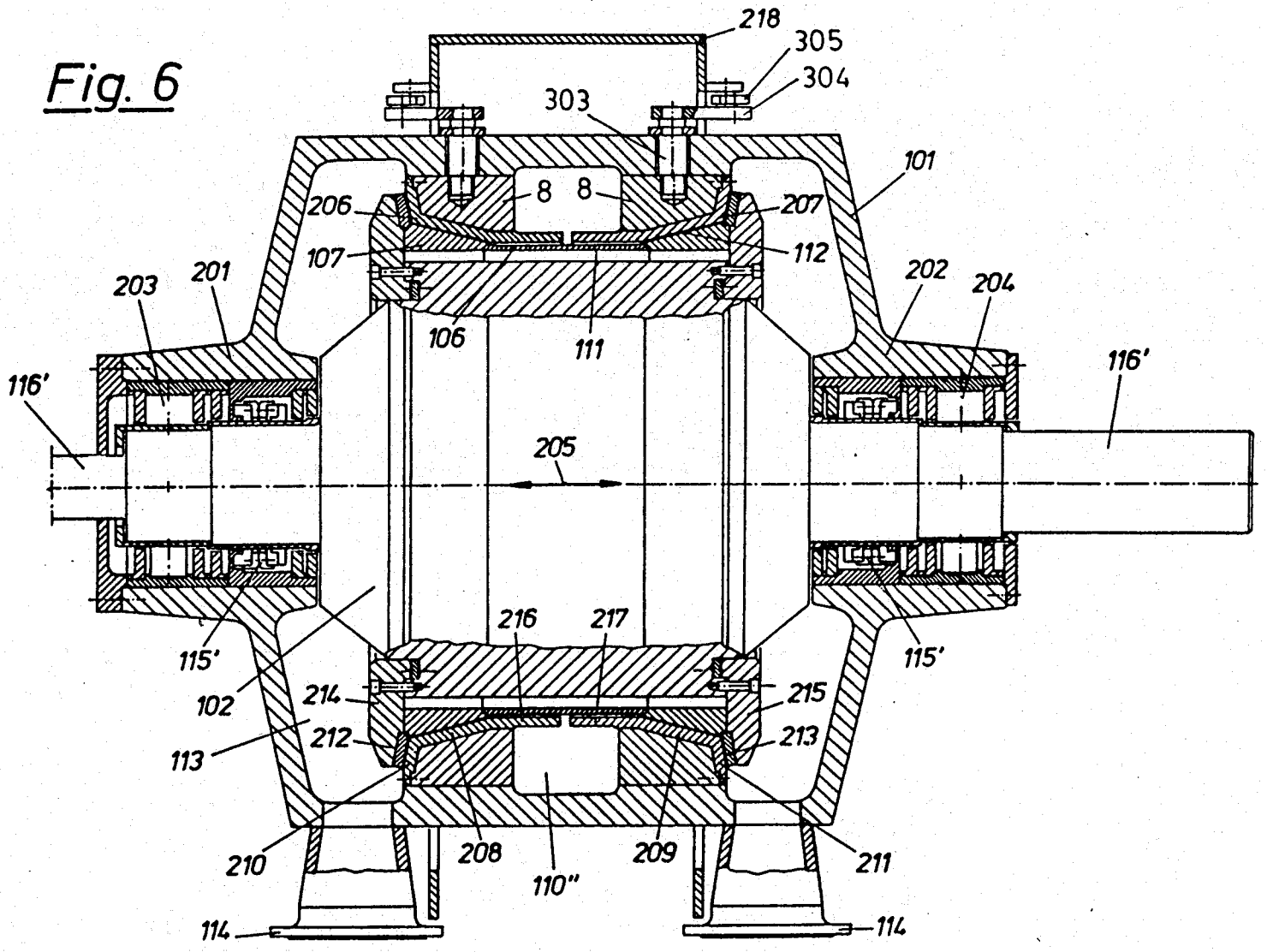
FIG. 6 to 8 represent a variant with modified grinding gap and floating rotor support in axial sectional view, front view and elevational view.
Figure 7:
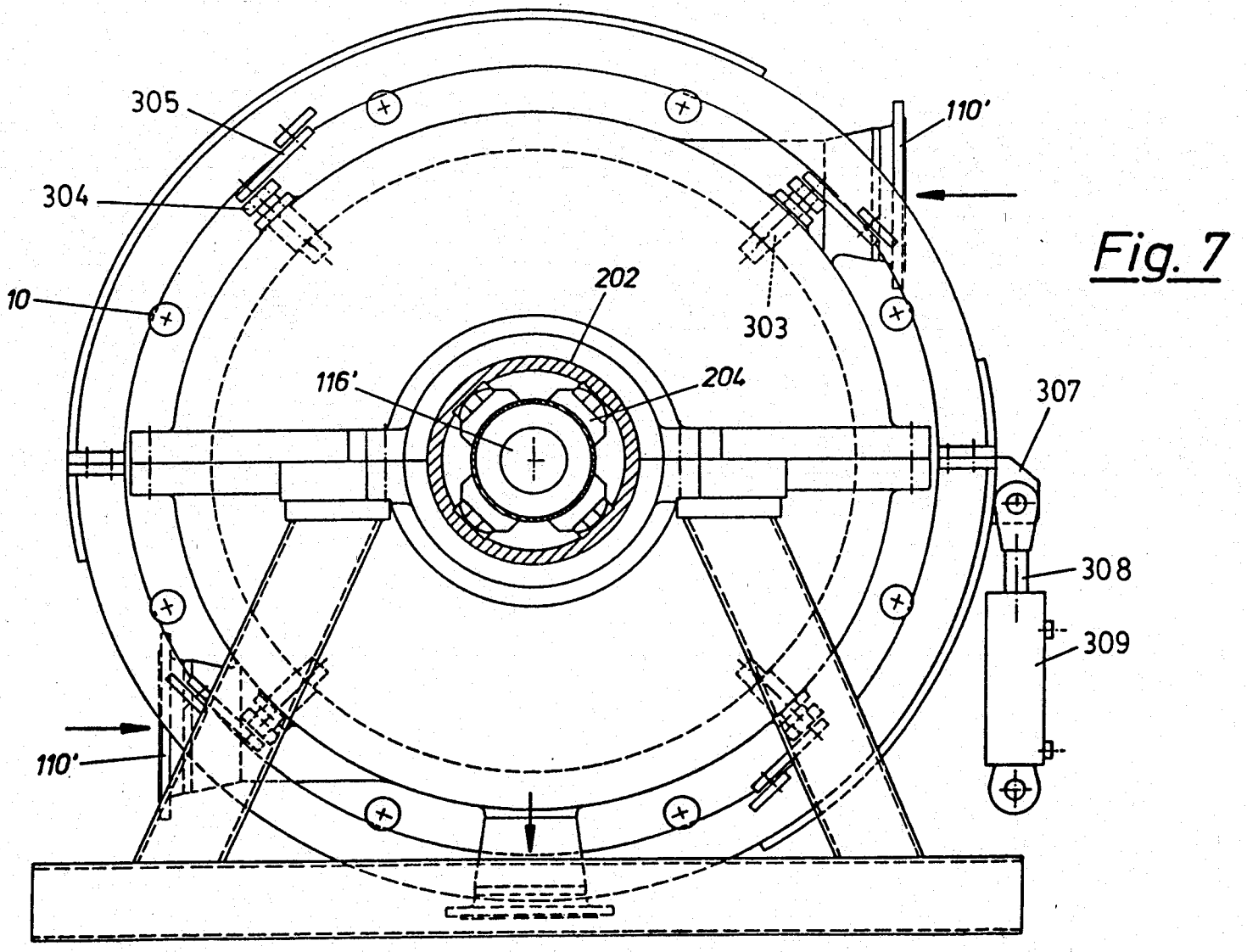
Figure 8:
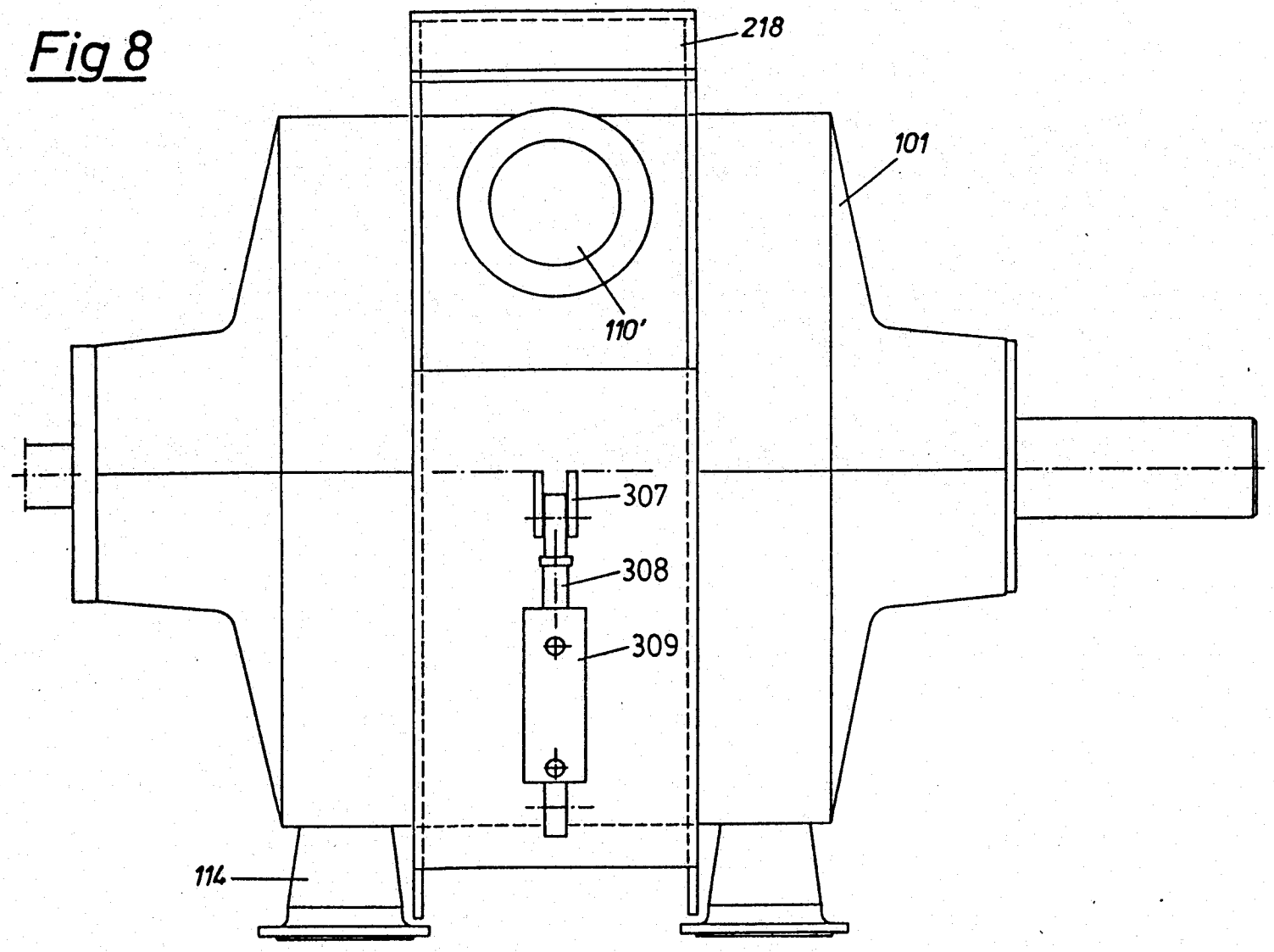

The embodiment according to FIGS. 6 to 8 differs from those previously shown above by the type of material feed, the special support of the rotor and the modified stator adjustment. Corresponding parts are provided with the same reference numbers as those shown in FIGS. 1 to 5.

In this case, the material feed is effected at 110' in two locations approximately tangentially to the rotor 102 into the annular space 110'' from which the material is then conveyed to the grinding plates. The shaft ends 116' of the rotor 102 and thus the rotor 102 itself are floatingly supported in this case. For this purpose, hydrostatic sliding bearings 203 and 204 are provided in the bearings 201 and 202. The bearings are sealed against the steam in the refiner housing 101 via sealing units 115'. The double arrow 205 indicates the rotor movement or floating rotor support made possible by the previously described support of the rotor. Although the adjustability of only one stator may be sufficient in this case, the adjustment of both of the stators 1, 1' and thus of the grinding plates 206, 207 attached to them is also provided for in this case; these grinding plates are provided, in addition to the frustoconical parts 206, 207, with parts 210, 211 enclosing an angle of nearly 90° with the rotor axis. Cooperating with the parts 210, 211 are additional grinding plates 212, 213 extending equally steeply to the rotor axis as the parts 210, 211 and supported by special rings 214, 215 connected to the rotor 102.

The adjustment of the stators 1, 1' and thus of the grinding plates 206, 207, 210, 211, but also of the cylindrically shaped grinding plates, is effected in a manner similar to that represented in FIGS. 1 to 5 via the parts 3 to 5, although in this case simultaneously and in opposing direction via curved hoops 218 which are uniformly displaced by the adjusting means 7 to 9. In view of the floatingly supported rotor, the adjustment of only one stator would be possible in this case as well. The second stator would then be rigidly supported in the housing. The mobility for the grinding gap adjustment is provided by the free axial displaceability (floating support) of the rotor.

We claim:

1. A grinding element in combination with drum refiners having at least one material feed inlet and an engine-driven rotor having a generally horizontal rotor axis, said rotor having a convex outer surface and having a plurality of grooves each with a hammerhead shape in cross section, all of said hammerhead shape grooves of said rotor having flanks, said flanks having a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attached, said housing having said inner wall with said grinding surface which is spaced apart from the rotor outer surface on which said grinding element is removably attached such that a grinding gap is formed between said removably attached grinding element on said outer surface of said rotor and the grinding surface on said inner wall, wherein said grinding element comprises:

(a) an element forming a hollow cylinder having a plurality of circumferential segments and provided with a surface facing the rotor axis and a surface facing away from the rotor axis, said surface facing away from the rotor axis being part of the convex outer surface of the rotor onto which said element is removably attached, said circumferential segments of said element further comprising:

(i) a plurality of anchoring projections of hammerhead shape in cross section extending from said surface facing the rotor axis, said anchoring projections of said circumferential segments being releasably engaged in said plurality of grooves in said convex outer surface of said rotor and each of which has a hammerhead shape in cross section, said anchoring projections of the circumferential segments of said removably attached element being retained by said hammerhead flanks of said grooves of the outer surface of said rotor, said retention preventing movement of said removably attached element radially outwardly from the rotor surface;

wherein said anchoring projections of said hammerhead shape of said circumferential segments of said removably attached element include a head portion and a stem portion with transition surfaces therebetween, the transition surfaces of each of said head and stem portions lying in a plane so that each of said transition surfaces forms an identical acute angle open to the rotor axis, but each angle being of opposing direction with a plane of symmetry of the anchoring projections each having said hammerhead shape.

2. The grinding element according to claim 1, wherein said circumferential segments of said removably attached element include a pair of lateral flanks disposed in an area outside of said anchoring projections and in planes extending generally radially to said generally horizontal rotor axis, said removably attached element consisting of a plurality of segments positioned on said convex outer surface of said rotor, such that the lateral flanks of the circumferential segments contact one another.

3. The grinding element according to claim 1, wherein said circumferential segments of said removably attached element further include ribs on the surface facing away from the rotor axis for forming a ribbed grinding surface on the rotor.

4. The grinding element according to claim 3, wherein said convex outer surface of the rotor comprises grooves in the rotor which form ribs of hammerhead shape in cross section, and wherein said removably attached element consists of a plurality of segments positioned on said convex outer surface of the rotor, such that each of said ribs on said rotor contacts two adjacent segments of said element for retaining the segments of said element on the convex outer surface of the rotor.

5. A grinding element according to claim 1 wherein said convex outer surface of the rotor includes a plurality of grooves in the rotor which form ribs of hammerhead shape in cross section, and wherein said removably attached element consists of a plurality of segments positioned on said rotor, such that each of said ribs on the rotor contacts two adjacent segments of said element for retaining the segments of said element on the rotor.

6. The grinding element according to claim 5; wherein said circumferential segments of said removably attached element include a pair of lateral flanks disposed in an area outside of said anchoring projections and in planes extending generally radially to said generally horizontal rotor axis, said removably attached element consisting of a plurality of segments positioned on said convex outer surface of said rotor, such that the lateral flanks of the circumferential segments contact one another.

7. A grinding element in combination with drum refiners having at least one material feed inlet and an engine-drive rotor having a generally horizontal rotor axis, said rotor having a convex outer surface and having a plurality of grooves each with a hammerhead shape in cross section, all of said hammerhead shape grooves of said rotor having flanks, said flanks having a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attached, said housing having said inner wall with said grinding surface which is spaced apart from the rotor outer surface on which said grinding element is removably attached such that a grinding gap is formed between said removably attached grinding element on said outer surface of said rotor and the grinding surface on said inner wall, wherein said grinding element comprises:

(a) an element forming a hollow cylinder having a plurality of circumferential segments and provided with a surface facing the rotor axis, and a surface facing away from the rotor axis, said surface facing away from the rotor axis being part of the convex outer surface of the rotor onto which said element is removably attached, said circumferential segments of said element further comprising:

(i) a plurality of anchoring projections of hammerhead shape in cross section extending from said surface facing the rotor axis, said anchoring projections of said circumferential segments being releasably engaged in said plurality of grooves in said convex outer surface of said rotor and each of which has a hammerhead shape in cross section, said anchoring projections of the circumferential segments of said removably attached element being retained by said hammerhead flanks of said grooves of the outer surface of said rotor, said retention preventing movement of said removably attached element radially outwardly from the rotor surface;

wherein said circumferential segments of said removably attached element further include ribs on the surface facing away from the rotor axis for forming a ribbed grinding surface on the rotor; and wherein said anchoring projections of said hammerhead shape of said circumferential segments of said removably attached element include a head portion and a stem portion with transition surfaces therebetween, the transition surfaces of each of said head and stem portions lying in a plate so that each of said transition surfaces forms an identical acute angle open to the rotor axis, but each angle being of opposing direction with a plane of symmetry of the anchoring projections each having said hammerhead shape.

8. A grinding element in combination with drum refiners having at least one material feed inlet and an engine-driven rotor having a generally horizontal rotor axis, said rotor having a convex outer surface and having a plurality of grooves which form ribs each with a hammerhead shape in cross section, all of said hammerhead shape ribs of said rotor having flanks, said flanks with a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attached, said housing having said inner wall with said grinding surface which is spaced apart from the rotor outer surface on which said grinding element is removably attached such that a grinding gap is formed between said removably attached grinding element on said outer surface of said rotor and the grinding surface on said inner wall, wherein said grinding element comprises:

(a) an element forming a hollow cylinder having a plurality of circumferential segments and provided with a surface facing the rotor axis and a surface facing away from the rotor axis, said surface facing away from the rotor axis being part of the convex outer surface of the rotor onto which said element is removably attached, said circumferential segments of said element further comprising:

(i) a plurality of anchoring projections of hammerhead shape in cross section extending from said surface facing the rotor axis, said anchoring projections of said circumferential segments being releasably engaged in said plurality of ribs in said convex outer surface of said rotor and each of which has a hammerhead shape in cross section, said anchoring projections of the circumferential segments of said removably attached element being retained by said hammerhead flanks of said ribs of the outer surface of said rotor, said retention preventing movement of said removably attached element radially outwardly from the rotor outer surface, wherein said removably attached element comprises a plurality of segments positioned on said rotor, such that each of said ribs on the rotor contacts two adjacent segments of said removably attached element on the rotor, and wherein said anchoring projections of said hammerhead shape of said segments of said removably attached element include a head portion and a stem portion with transition surfaces therebetween, the transition surfaces of each of said head and stem portions lying in a plane so that each of said transition surfaces forms an identical acute angle open to the rotor axis, but each angle being of opposing direction with a plane of symmetry of the anchoring projections each having said hammerhead shape.

9. In a drum refiner for the grinding of fibrous material, said drum refiners having at least one material feed inlet and an engine-driven rotor having a generally horizontal rotor axis, said rotor having a convex outer surface and having a plurality of grooves each with a hammerhead shape in cross section, all of said hammerhead shape grooves of said rotor having flanks, said flanks having a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attachable, said housing having said inner wall with said grinding surface which is spaced apart from the rotor outer surface on which said grinding element is removably attachable such that a grinding gap is formed between said removably attachable grinding element on said outer surface of said rotor and the grinding surface on said inner wall, the improvement comprising:

a) a grinding element being generally formed as a segment of a hollow cylinder and provided with a surface facing the rotor axis, and with a surface facing away from the rotor axis, said surface facing away from the rotor axis being part of the convex outer surface of the rotor onto which said grinding element is removably attachable, said segment further comprising:

(i) an anchoring projection of hammerhead shape in cross section extending from said surface facing the rotor axis, said anchoring projection of said segment being releasably engagable in said grooves in said convex outer surface of said rotor, said anchoring projection of said segment of said removably attachable grinding element being retained by said hammerhead flanks of said grooves of the outer surface of said rotor, said retention preventing movement of said removably attachable grinding element radially outwardly from the rotor surface;

wherein said anchoring projection of said hammerhead shape of said segment of said removably attachable grinding element includes a head portion and a stem portion with transition surfaces therebetween, the transition surfaces of each of said head and stem portions lying in a plane so that each of said transition surfaces forms an identical acute angle open to the rotor axis, but each angle being of opposing direction with a plane of symmetry of the anchoring projection having said hammerhead shape.

10. In a drum refiner for the grinding of fibrous material, said drum refiners having at least one material feed inlet and an engine-driven rotor having a generally horizontal rotor axis, said rotor having a convex outer surface and having a plurality of grooves each with a hammerhead shape in cross section, all of said hammerhead shape grooves of said rotor having flanks, said flanks having a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attachable, said housing having said inner wall with said grinding surface which is spaced apart from the rotor outer surface on which said grinding element is removably attachable such that a grinding gap is formed between said removably attachable grinding element on said outer surface of said rotor and the grinding surface on said inner wall, the improvement comprising:

a) a grinding element being generally formed as a segment of a hollow cylinder and provided with a surface facing the rotor axis, and with a surface facing away from the rotor axis, said surface facing away from the rotor axis being part of the convex outer surface of the rotor onto which said grinding elements is removably attachable, said segment further comprising:

(i) an anchoring projection of hammerhead shape in cross section extending from said surface facing the rotor axis, said anchoring projection of said segment being releasably engagable in said grooves in said convex outer surface of said rotor, said anchoring projection of said segment of said removably attachable grinding element being retained by said hammerhead flanks of said grooves of the outer surface of said rotor, said retention preventing movement of said removably attachable grinding element radially outwardly from the rotor surface;

wherein said segment of said removably attachable grinding element further includes ribs on the surface facing away from the rotor axis for forming a ribbed grinding surface on the rotor; and wherein said anchoring projection of said hammerhead shape of said segment of said removably attachable grinding element includes a head portion and a stem portion with transition surfaces therebetween, the transition surfaces of each of said head and stem portions lying in a plane so that each of said transition surfaces forms an identical acute angle open to the rotor axis, but each angle being of opposing direction with a plane of symmetry of the anchoring projection having said hammerhead shape.

11. In a drum refiner for the grinding of fibrous material, said drum refiners having at least one material feed inlet and an engine-driven rotor having a generally horizontal rotor axis, said rotor having a convex outer surface and having a plurality of grooves which form ribs each with a hammerhead shape in cross section, all of said hammerhead shape ribs of said rotor having flanks, said flanks with a hammerhead shape in cross section and having a stem and a head wider than the stem, said flanks including a head portion and a stem portion with transition surfaces therebetween, said drum refiner further comprising a housing for receiving the rotor therein and having an inner wall with a grinding surface facing and conforming to the rotor outer surface on which said grinding element is removably attachable, said housing having said inner wall with said grinding surface which is spaced apart from the rotor outer surface on which said grinding element is removably attachable such that a grinding gap is formed between said removably attachable grinding element on said outer surface of said rotor grinding surface on said inner wall, the improvement comprising:

a) a grinding element formed as a segment of a hollow cylinder and provided with a surface facing the rotor axis, and with a surface facing away from the rotor axis, said surface facing away from the rotor axis being part of the convex outer surface of the rotor onto which said grinding element is removably attachable, said segment further comprising:

(i) an anchoring projection of hammerhead shape in cross section extending from said surface facing the rotor axis, said anchoring projection of said segment being releasably engagable in said ribs in said convex outer surface of said rotor, said anchoring projection of said segment of said removably attachable grinding element being retained by said hammerhead flanks of said ribs of the outer surface of said rotor, said retention preventing movement of said removably attachable grinding element radially outwardly from the rotor surface;

wherein said removably attachable grinding element being contactable to two of said ribs on the rotor and each of said ribs on the rotor being contactable to two adjacent removably attachable grinding elements on the rotor; and wherein said anchoring projection of said hammerhead shape of said removably attachable grinding element includes a head portion and a stem portion with transition surfaces therebetween, the transition surfaces of each of said head and stem portions lying in a plane so that each of said transition surfaces forms an identical acute angle open to the rotor axis, but each angle being of opposing direction with a plane of symmetry of the anchoring projection having said hammerhead shape.

* * * * *